United States Patent [19]

Lyons

[11] 4,332,381

[45] Jun. 1, 1982

[54] EXERCISING DEVICE

[76] Inventor: Sanford D. Lyons, 2152 S. Shore Dr., Erie, Pa. 16506

[21] Appl. No.: 84,415

[22] Filed: Oct. 12, 1979

[51] Int. Cl.[3] ..... A63B 23/02

[52] U.S. Cl. ..... 272/144; 272/63; 272/93

[58] Field of Search ..... 272/61–64, 272/85, 93, 109–114, 134, 144, 145, 116, 117, 118

[56] References Cited

U.S. PATENT DOCUMENTS

| | | | |
|---|---|---|---|
| 860,517 | 7/1907 | Berglund | 272/63 |
| 1,456,317 | 5/1923 | Lauer | 272/145 |
| 2,759,730 | 8/1956 | Berry | 272/145 |
| 3,130,968 | 4/1964 | DeFeen | 272/63 X |
| 3,682,475 | 8/1972 | Walker | 272/145 |
| 3,790,164 | 2/1974 | Flanigan | 272/145 |
| 3,879,033 | 4/1975 | Martin | 272/111 |
| 4,125,258 | 11/1978 | McArthur | 272/118 |
| 4,241,915 | 12/1980 | Noble et al. | 272/145 X |

FOREIGN PATENT DOCUMENTS

| | | | |
|---|---|---|---|
| 842613 | 6/1952 | Fed. Rep. of Germany | 272/109 |
| 316953 | 4/1934 | Italy | 272/144 |
| 132348 | 6/1929 | Switzerland | 272/111 |

*Primary Examiner*—Richard J. Apley

[57] ABSTRACT

An exercising device made up of a high platform and spaced low pads supported on columns. The columns are supported on an H-shaped frame with the high platform column supported at the juncture of one leg of the H and the bar of the H at one side and the low pads supported on the other leg of the H when performing push-ups. The length of the bar of the H is adjustable to move the low pads toward and away from the high platform, the low pads can be adjusted toward and away from each other so that a person can sit on them and do sit-ups.

The frame is adapted to have a person rest his feet on the high platform and support his hands on the low platform and do push-ups.

13 Claims, 1 Drawing Figure

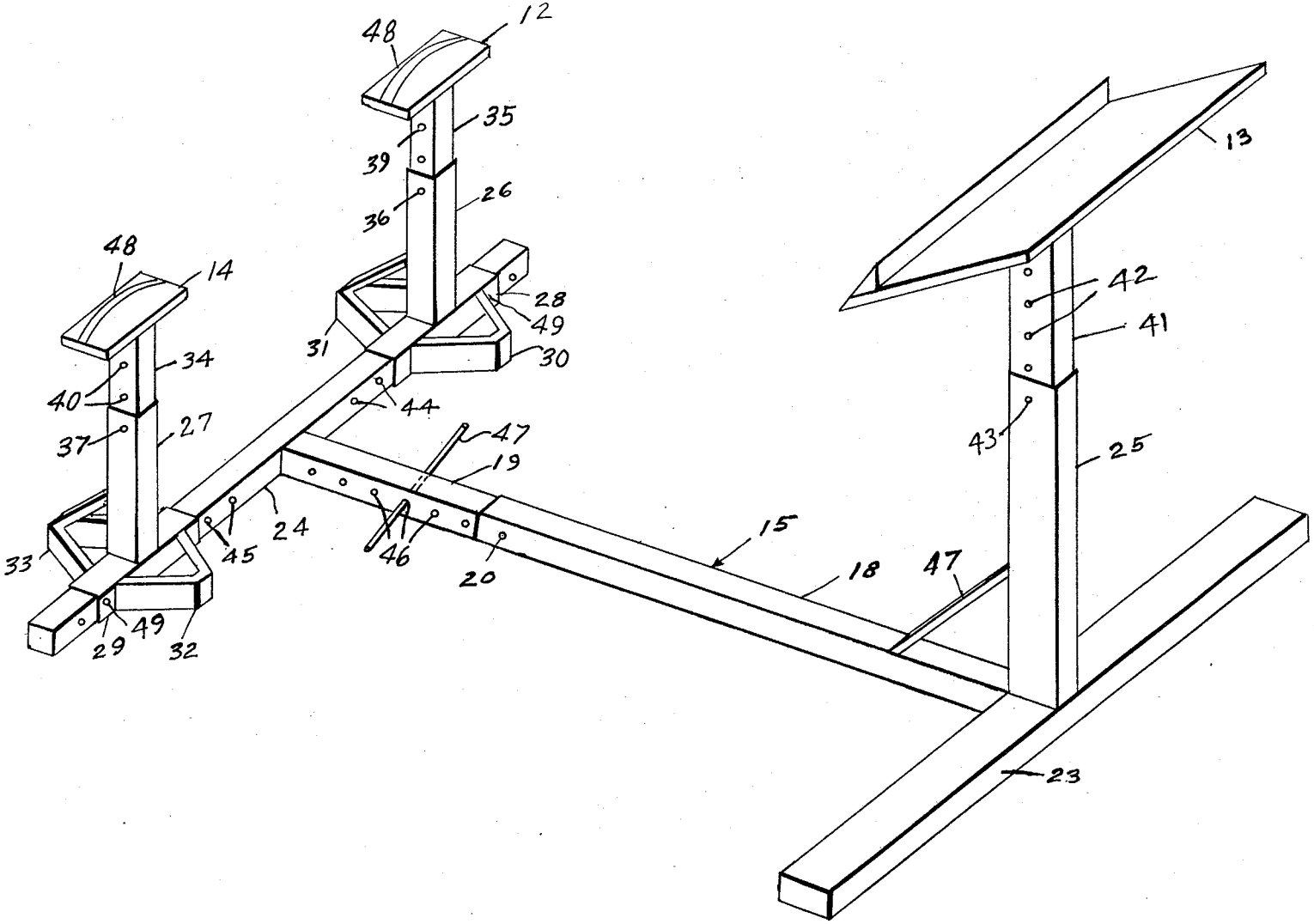
13
42
41
25
23
43
47
18
15
12
35
26
28
49
30
47
19
20
48
39
36
44
46
31
24
45
14
34
27
32
48
40
37
49
29
33

EXERCISING DEVICE

GENERAL DESCRIPTION OF THE INVENTION

A bench designed to maximize the strength development of the user is disclosed. The bench may be used for both push-ups or sit-ups. It is completely adjustable for the individual user in order to allow him or her to obtain the greatest mechanical advantage from the exercise.

When performing push-ups, the user places his feet on the higher platform and hands on the two lower pads. The advantage of this is to move the center of gravity of the user to the shoulder blades, also there is no opportunity for the user to rest and a full range of motion may be obtained by passing the plane of the hands with the chest.

When performing sit-ups, the user slides the two low posts to the center and replaces the hand pads with a double butted seat. A foot holder is placed into the desired hole on the main bar of the frame. The user sits on the seat so that he is facing toward the platform at the other end and the feet are placed under the foot holder bar 47 inserted through one of the holes 46 and the user leans back to perform sit-ups. The sit-ups are performed by passing the plane of the seat with the torso and then returning to a rear sitting position without passing the perpendicular. This will ensure that the stomach and lower back muscles do not have an opportunity to rest.

REFERENCE TO PRIOR ART

Various types of exercising devices have been proposed. U.S. Pat. No. 3,572,701 shows an apparatus for physical exercise having a handrail support, a longitudinal guide track extending in a plane beneath the fore and aft of the handrail support, and a carriage slidable along the rail.

U.S. Pat. No. 3,731,921 shows a bench for simulating and developing swimming movements wherein the person laying on the bench may exercise in a manner simulating various swimming strokes. The crank arms being adjustable in effective length and adjustable angularly relative to each other.

U.S. Pat. No. 2,682,402 shows a collapsible platform and framework exercising apparatus.

U.S. Pat. No. 3,117,782 shows a posture correcting structure made up of a bench for supporting the back of a person and cables for exercising the legs.

U.S. Pat. No. 3,948,513 shows an exercising apparatus having vertically and horizontally adjustable parts.

OBJECTS OF THE INVENTION

It is an object of the invention to provide an improved exercising apparatus.

Another object of the invention is to provide a bench designed to maximize the strength development of the user.

Another object of the invention is to provide a bench suitable for use in performing sit-ups and push-ups which is completely adjustable to the individual user in order to allow him or her the greatest mechanical advantage.

Another object of the invention is to provide an exercising device which enables the user to perform both sit-ups and push-ups thereon.

Another object of the invention is to provide an exercising bench having foot holders and hand holders that may be used for performing both sit-ups and push-ups.

Another object of the invention is to provide an apparatus for exercising the stomach and lower back muscles as well as arms and legs.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

The drawing shows an isometric view of the apparatus according to the invention.

DETAILED DESCRIPTION OF THE DRAWINGS

Now, with more particular reference to the drawings, the exercising bench indicated generally at 10 is made up of a high platform 13 and two spaced low pads 12 and 14. A frame 15 supports the platform on the high post 25 and support pads on the lower posts 26 and 27 so that the posts 25 can be moved toward and away from the others. The heights of the posts 25, 26 and 27 are also adjustable. It will be noted that the post 25 is considerably higher than the posts 26 and 27 so that the person's feet will be nearly in a plane passing through his shoulders when he is in the higher position during push-ups.

The frame 15 is generally U-shaped with the end bars 23 and 24 welded to the ends of the main bar 15 and the post 25 welded to the intermediate part of end bar 23. Posts 26 and 27 are welded to the sleeves 28 and 29 respectively. Sleeves 28 and 29 are telescopically received on the ends of bar 24 and can be selectively adjusted to various positions by means of a pin extending through the holes 49 in sleeves 28 and 29 and selectively engaging one of the holes 44 or 45 in the end bar 24 thereby providing a means for adjusting the pads toward and away from one another. Sleeve 28 has generally U-shaped stabilizing legs 30 and 31 welded to it and sleeve 29 has generally U-shaped stabilizing legs 32 and 33 welded to it. Legs 30, 31, 32 and 33 stabilize the posts 26 and 27 preventing them from swinging or rocking during the time that exercises are being performed on the bench.

Pads 12 and 14 are welded to legs 34 and 35, but may be covered with soft material for comfort of the hands. Legs 34 and 35 are slidably received in legs 26 and 27 and held in adjusted position by pins in the holes 36 and 37 in the lower posts 26 and 27 and selectively received in holes 39 and 40. Hand retaining straps 48 are attached at their ends to pads 12 and 14.

The platform 13 is welded to leg 41 and leg 41 has spaced holes 42. A suitable pin can be inserted in the hole 43 and in the hole 42 to hold the platform 13 in the desired elevation above the pads and the pads 12 and 14 can be adjusted toward and away from each other and up and down to suit the taste of individual performing on the bench.

When the posts 26 and 27 are moved toward each other moving pads 12 and 14 into close relation with each other, the person using the device can sit on pads 12 and 14 or he can put a single seat across pads 12 and 14 on which he can sit hooking his feet under the foot holder bar 47 extended through one of the holes 46. The brace 47 is welded to the main bar 15 and to the post 25 to give the frame additional rigidity.

While the mention of welding implies that the device be made of metallic material such as steel or aluminum, the bench may be made of any other suitable material familiar to those skilled in the art.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An exercising device comprising a main frame comprising a main bar having a first end and a second end, a first end bar having a first end and a second end and an intermediate part, said intermediate part of said first end bar being fixed to said second end of said first main bar, and extending laterally therefrom, a first post, a second post, and a third post, each said post having a first end and a second end, said first end of said first post being supported on said first end of said first end bar, said first end of said second post being supported on said second end of said first end bar, said first end of said third post being fixed to said first end of said main bar, said posts extending upwardly from above said main bar, (a platform, a first pad, and a second pad,)

a platform, a first pad, and a second pad, said platform being supported on said second end of said third post, said first pad being supported on said second end of said first post, said second pad being supported on said second end of said second post, each of said pads has a hand engaging strap fixed to the sides thereof and extending across to receive the hands of a user between said strap and said pad, whereby a user may rest his hands on said pads and rest his feet on said platform and do push-ups moving his center of gravity to the shoulder blades.

2. The bench recited in claim 1 wherein said third post has a brace attached to its intermediate part and to said main bar.

3. The bench recited in claim 1 wherein a foot supporting member is supported on said main bar for engaging the feet of a user when said user is sitting on said pads for doing sit-ups.

4. The exercise device recited in claim 1 wherein said posts are each made of a lower member and an upper member telescopically received in said lower member.

5. The exercise device recited in claim 4 wherein said lower member of each said first posts is welded to a sleeve and each said sleeve is telescopically received on a laterally extending frame member of said bench.

6. The exercising device recited in claim 5 wherein said (said frame has a main member) main bar is made of two members telescopically connected together.

7. The exercising device recited in claim 6 wherein said exercising device is made of tubular parts.

8. The exercising device recited in claim 7 wherein said tubular parts are square in cross section.

9. The bench recited in claim 1 wherein (said frame is generally H shaped and) a second end bar is attached to said first end of said main bar and extends laterally therefrom and forming a generally H-shaped frame.

10. The bench recited in claim 9 wherein said first post and said second post are supported on said first bar by means of sleeves slidable laterally thereon.

11. The bench recited in claim 10 wherein said main bar comprises two parts telescopically slidable relative to each other whereby said platform can be adjusted toward and away from said pads.

12. The device recited in claim 11 wherein said sleeves are each provided with a hole therein and said ends of said first bar have spaced holes whereby said sleeves can be fixed in adjusted position relative to each other.

13. The bench recited in claim 10 wherein said sleeves have legs attached to the side adjacent to said platform and to the side remote from said platform.

* * * * *